US010977981B2

(12) United States Patent
Lv et al.

(10) Patent No.: US 10,977,981 B2
(45) Date of Patent: Apr. 13, 2021

(54) DEVICE FOR CONTROLLING LUMINANCE, METHOD THEREOF, AND DISPLAY DEVICE

(71) Applicants: Beijing BOE Optoelectronics Technology Co., Ltd., Beijing (CN); BOE Technology Group Co., Ltd., Beijing (CN)

(72) Inventors: Hongliang Lv, Beijing (CN); Qingnan Ai, Beijing (CN); Boning Wang, Beijing (CN); Ruifeng Yang, Beijing (CN); Litao Fan, Beijing (CN); Yufei Liu, Beijing (CN); Huaxu Yang, Beijing (CN); Libao Cui, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 75 days.

(21) Appl. No.: 16/388,425

(22) Filed: Apr. 18, 2019

(65) Prior Publication Data

US 2020/0082748 A1 Mar. 12, 2020

(30) Foreign Application Priority Data

Sep. 12, 2018 (CN) ..... 201811063544.7

(51) Int. Cl.
*G09G 3/20* (2006.01)

(52) U.S. Cl.
CPC ... *G09G 3/2003* (2013.01); *G09G 2320/0233* (2013.01); *G09G 2320/0666* (2013.01)

(58) Field of Classification Search
CPC . G09G 2320/02333; G09G 2320/0242; G09G 2320/0626; G09G 2320/0666
See application file for complete search history.

(56) References Cited

U.S. PATENT DOCUMENTS

2010/0007595 A1* 1/2010 Chiang ..... G09G 3/3648 345/98
2015/0084996 A1* 3/2015 Yamakawa ..... H04N 9/73 345/690
2015/0138260 A1* 5/2015 Yamakawa ..... G09G 3/36 345/694

* cited by examiner

*Primary Examiner* — Roy P Rabindranath
(74) *Attorney, Agent, or Firm* — Westman, Champlin & Koehler, P.A.

(57) ABSTRACT

Embodiments of the present disclosure provide a device for controlling luminance, a method of controlling luminance and a display device. The method of controlling luminance may comprise: obtaining a theoretical white balanced luminance value for each color of sub-pixel included in N pixels; obtaining a luminance controlling value for other colors of sub-pixels except for a $i^{th}$ color of sub-pixel included in each of the N pixels; and adjusting luminance of the other colors of sub-pixels except for the $i^{th}$ color of sub-pixel included in each pixel according to the luminance controlling value. The method of controlling luminance can be used in luminance controlling devices.

16 Claims, 4 Drawing Sheets

DEVICE FOR CONTROLLING LUMINANCE, METHOD THEREOF, AND DISPLAY DEVICE

CROSS-REFERENCE TO RELATED APPLICATION(S)

This application claims the priority of Chinese Patent Application No. 201811063544.7, filed on Sep. 12, 2018, the entire contents of which are hereby incorporated by reference.

TECHNICAL FIELD

Embodiments of the present disclosure relate to the field of display technologies, and in particular, to a device for controlling luminance, a method thereof and a display device.

BACKGROUND

A display panel configured with a slim bezel may have a high screen occupancy. However, it may have a problem of "edge leakage". One solution to solve the problem of "edge leakage" is to increase the width of a black bezel toward a display region, thereby blocking part of sub-pixels.

However, such a solution may cause color at edges of a displayed screen to be abnormal when displaying a white image.

SUMMARY

Embodiments of the present disclosure may provide a device for controlling luminance, comprising:

a memory configured to store instructions; and at least one processor configured to execute the instructions stored in the memory to:

obtain a theoretical white balanced luminance value for each color of sub-pixel included in N pixels, wherein the N pixels are adjacent, and N is an integer greater than or equal to 1;

set a luminance controlling value for other colors of sub-pixels except for a $i^{th}$ color of sub-pixel included in each of the N pixels, according to the theoretical white balanced luminance value for each color of sub-pixel and a sum of luminance loss value for the $i^{th}$ color of sub-pixels included in the N pixels, in response to the $i^{th}$ color of sub-pixel included in a $t^{th}$ pixel of the N pixels having a luminance loss, wherein t is an integer greater than or equal to 1 and less than or equal to N, and i is an integer greater than or equal to 1; and adjust luminance of the other colors of sub-pixels except for a $i^{th}$ color of sub-pixel included in each of the N pixels according to the luminance controlling value, so that a ratio between a sum of luminance values of the $i^{th}$ color of sub-pixels included in the N pixels and a sum of adjusted luminance values of the other colors of sub-pixels except for the $i^{th}$ color of sub-pixels included in the N pixels is coincident with a white balanced luminance value ratio.

For example, the processor is further configured to set the luminance controlling value for the other colors of sub-pixels, so as to satisfy at least one of:

a ratio between the luminance controlling value and the theoretical white balanced luminance value for each of the other colors of sub-pixels except for the $i^{th}$ color of sub-pixel included in each pixel being equal to a ratio between the sum of the luminance loss values and a sum of theoretical white balanced luminance values for the $i^{th}$ color of sub-pixels included in the N pixels, and a ratio between a sum of luminance controlling values and a sum of theoretical white balanced luminance values for each of the other colors of sub-pixels except for the $i^{th}$ color of sub-pixel included in the N adjacent pixel being equal to a ratio between the sum of the luminance loss values and the sum of the theoretical white balanced luminance values for the $i^{th}$ color of sub-pixels included in the N pixels.

For example, the processor is further configured to adjust the luminance of the other colors of sub-pixels, so as to satisfy at least one of:

a ratio among the adjusted luminance values of the other colors of sub-pixels except for the $i^{th}$ color of sub-pixel included in each pixel being equal to the theoretical white balanced luminance value ratio of the other colors of sub-pixels; or a ratio among the adjusted luminance values of the same color of sub-pixels except for the $i^{th}$ color of sub-pixels included in the N pixels being equal to the theoretical white balanced luminance value ratio of the same color of sub-pixels.

For example, the $i^{th}$ color of sub-pixel has an invalid display region; and the processor is further configured to:

obtain an invalid display pixel occupancy $$\frac{x}{a}$$

for the $i^{th}$ color of sub-pixel included in the $t^{th}$ pixel, according to an area of the invalid display region x and the area of a theoretical display region a for the $i^{th}$ color of sub-pixel included in the $t^{th}$ pixel; obtain the luminance loss value $\Delta L_{ti}$ for the $i^{th}$ color of sub-pixel included in the $t^{th}$ pixel, according to the invalid display pixel occupancy $$\frac{x}{a}$$

and the theoretical white balanced luminance value $L_{ti}$ for the $i^{th}$ color of sub-pixel, wherein $$\Delta L_{ti} = \frac{x}{a} L_{ti};$$

and obtain the sum of the luminance loss values $\Delta L_i$ for the $i^{th}$ color of sub-pixels included in the N pixels, according to the luminance loss value $\Delta L_{ti}$ for the $i^{th}$ color of sub-pixel included in the $t^{th}$ pixel.

For example, the luminance controlling value for other colors of sub-pixels except for the $i^{th}$ color of sub-pixel included in each pixel are set to $$\Delta L_{js} = \frac{\frac{x}{a} L_{ti}}{\sum_{j=1}^{N} L_{ji}} L_{js},$$

wherein $$\sum_{j=1}^{N} L_{ji}$$

indicates for the sum of the theoretical white balanced luminance values for the $i^{th}$ color of sub-pixels included in the N pixels, $L_{ji}$ indicates for the theoretical white balanced luminance value for the $i^{th}$ color of sub-pixel included in a $j^{th}$ pixel of the N pixels, $L_{js}$ indicates for the theoretical white balanced luminance value for a $s^{th}$ color of sub-pixel included in the $j^{th}$ pixel, and $\Delta L_{js}$ indicates for a luminance controlling parameter for a $s^{th}$ color of sub-pixel included in the $j^{th}$ pixel, wherein j is an index number of the pixel which is greater than or equal to 1 and less than or equal to N, and s is an index number of other colors of sub-pixels except for the $i^{th}$ color of sub-pixel included in each pixel, and is an integer greater than 0 and not equal to i.

For example, the processor is further configured to obtain the sum of the theoretical white balanced luminance values for the $i^{th}$ color of sub-pixels included in the N pixels, according to the theoretical white balanced luminance values for the $i^{th}$ color of sub-pixel included in each of the N pixels; obtain a luminance reduction rate $\eta_{js}$ for the other colors of sub-pixels except for the $i^{th}$ color of sub-pixel included in each pixel, according to the sum of the theoretical white balanced luminance values and the sum of the luminance loss values for the $i^{th}$ color of sub-pixels included in the N pixels; and obtain the luminance controlling value for the other colors of sub-pixels except for the $i^{th}$ color of sub-pixel included in each pixel, according to the luminance reduction rate $\eta_{js}$ and the theoretical whites balanced luminance value for the other colors of sub-pixels except for the $i^{th}$ color of sub-pixel included in each pixel.

For example, the luminance reduction rate for the other colors of sub-pixels except for the $i^{th}$ color of sub-pixel included in each pixel is as follows:

$$\eta_{js} = \frac{\frac{x}{a} L_{ti}}{\sum_{j=1}^{N} L_{ji}},$$

wherein j is the index number of the pixel which is greater than or equal to 1 and less than or equal to N, and s is an index number of other colors of sub-pixels except for the $i^{th}$ color of sub-pixel included in each pixel, and is an integer greater than 0 and not equal to i.

The embodiments of the present disclosure may further provide a method of controlling a luminance, comprising:

obtaining a theoretical white balanced luminance value for each color of sub-pixel included in N pixels, wherein N is an integer greater than or equal to 1;

setting a luminance controlling value for other colors of sub-pixels except for a $i^{th}$ color of sub-pixel included in each of the N pixels, according to the theoretical white balanced luminance value for each color of sub-pixel and a sum of the luminance loss values for the $i^{th}$ color of sub-pixels included in the N pixels, in response to the $i^{th}$ color of sub-pixel included in a $t^{th}$ pixel of the N pixels having a luminance loss, wherein t is an integer greater than or equal to 1 and less than or equal to N, and i is an integer greater than or equal to 1; and adjusting luminance of the other colors of sub-pixels according to the luminance controlling value, so that a ratio between the sum of the luminance values of the $i^{th}$ color of sub-pixels included in the N pixels and the sum of the adjusted luminance values of the other colors of sub-pixels except for the $i^{th}$ color of sub-pixels included in the N pixels is coincident with a white balanced luminance value ratio.

For example, the setting luminance controlling value for the other colors of sub-pixels so as to satisfy at least one of:

a ratio between the luminance controlling value and the theoretical white balanced luminance value for each of the other colors of sub-pixels except for the $i^{th}$ color of sub-pixel included in each pixel being equal to a ratio between the sum of the luminance loss values to the sum of the theoretical white balanced luminance values for the $i^{th}$ color of sub-pixels included in the N pixels, and a ratio between a sum of the luminance controlling values and the sum of the theoretical white balanced luminance values for each of the other colors of sub-pixels except for the $i^{th}$ color of sub-pixel included in the N adjacent pixel being equal to a ratio between the sum of the luminance loss values and the sum of the theoretical white balanced luminance values for the $i^{th}$ color of sub-pixels included in the N pixels.

For example, the $i^{th}$ color of sub-pixel included in the $t^{th}$ pixel has an invalid display region; and the method further comprising:

obtaining an invalid display pixel occupancy $$\frac{x}{a}$$

for the $i^{th}$ color of sub-pixel included in the $t^{th}$ pixel, according to an area of the invalid display region x and the area of a theoretical display region a for the $i^{th}$ color of sub-pixel included in the $t^{th}$ pixel;

obtaining the luminance loss value $\Delta L_{ti}$ for the $i^{th}$ color of sub-pixel included in the $t^{th}$ pixel, according to the invalid display pixel occupancy $$\frac{x}{a}$$

and the theoretical white balanced luminance value $L_{ti}$ for the $i^{th}$ color of sub-pixel, wherein $$\Delta L_{ti} = \frac{x}{a} L_{ti};$$

and obtaining the sum of the luminance loss values $\Delta L_i$ for the $i^{th}$ color of sub-pixels included in the N pixels, according to the luminance loss value $\Delta_{ti}$ for the $i^{th}$ color of sub-pixel included in the $t^{th}$ pixel.

For example, the luminance controlling value for other colors of sub-pixels except for the $i^{th}$ color of sub-pixel included in each pixel are set to $$\Delta L_{js} = \frac{\frac{x}{a} L_{ti}}{\sum_{j=1}^{N} L_{ji}} L_{js},$$

wherein $$\sum_{j=1}^{N} L_{ji}$$

indicates for the sum of the theoretical white balanced luminance values for the $i^{th}$ color of sub-pixels included in the N pixels, $L_{ji}$ indicates for the theoretical white balanced luminance value for the $i^{th}$ color of sub-pixel included in a $j^{th}$ pixel of the N pixels, $L_{js}$ indicates for the theoretical white balanced luminance value for a $s^{th}$ color of sub-pixel included in the $j^{th}$ pixel, and $\Delta L_{js}$ indicates for a luminance controlling parameter for a $s^{th}$ color of sub-pixel included in the $j^{th}$ pixel, wherein j is an index number of the pixel which is greater than or equal to 1 and less than or equal to N, and s is an index number of other colors of sub-pixels except for the $i^{th}$ color of sub-pixel included in each pixel, and is an integer greater than 0 and not equal to i.

For example, the luminance controlling value for the other colors of sub-pixels except for the $i^{th}$ color of sub-pixel included in each of the N pixels is set according to the theoretical white balanced luminance value for each color of sub-pixel and a sum of the luminance loss values for the $i^{th}$ color of sub-pixels included in the N pixels by:

obtaining the sum of the theoretical white balanced luminance values for the $i^{th}$ color of sub-pixels included in the N pixels, according to the theoretical white balanced luminance values for the $i^{th}$ color of sub-pixel included in each of the N pixels;

obtaining a luminance reduction rate $\eta_{js}$ for the other colors of sub-pixels except for the $i^{th}$ color of sub-pixel included in each pixel, according to the sum of the theoretical white balanced luminance values and the sum of the luminance loss values for the $i^{th}$ color of sub-pixels included in the N pixels; and obtaining the luminance controlling value for the other colors of sub-pixels except for the $i^{th}$ color of sub-pixel included in each pixel, according to the luminance reduction rate $\eta_{js}$ and the theoretical whites balanced luminance value for the other colors of sub-pixels except for the $i^{th}$ color of sub-pixel included in each pixel.

For example, the luminance reduction rate for the other colors of sub-pixels except for the $i^{th}$ color of sub-pixel included in each pixel is as follows:

$$\eta_{js} = \frac{\frac{x}{a} L_{ti}}{\sum_{j=1}^{N} L_{ji}},$$

wherein j is the index number of the pixel which is greater than or equal to 1 and less than or equal to N, and s is an index number of other colors of sub-pixels except for the $i^{th}$ color of sub-pixel included in each pixel, and is an integer greater than 0 and not equal to i.

For example, the luminance of the other colors of sub-pixels is adjusted so as to satisfy at least one of:

a ratio among the adjusted luminance values of the other colors of sub-pixels except for the $i^{th}$ color of sub-pixel included in each pixel being equal to the theoretical white balanced luminance value ratio of the other colors of sub-pixels; or a ratio among the adjusted luminance values of the same color of sub-pixels except for the $i^{th}$ color of sub-pixels included in the N pixels being equal to the theoretical white balanced luminance value ratio of the same color of sub-pixels.

The embodiments of the present disclosure may further provide a display device comprising the device for controlling luminance.

For example, the display device further comprising a bezel; wherein the N pixels are arranged along an extending direction of the bezel, and the $t^{th}$ pixel of the N pixels is closest to the bezel.

BRIEF DESCRIPTION OF THE DRAWINGS

The drawings described herein are intended to provide a further understanding for embodiments of the disclosure, and constitute a part of the embodiments. The examples and descriptions of the embodiments of the disclosure are intended to explain the embodiments, but not to define them. In the drawing.

DETAILED DESCRIPTION

Technical solutions of the embodiments of the present disclosure will be clearly and completely described below in conjunction with the drawings. It should be apparent that the described embodiments are only a part of the embodiments of the present disclosure, and not all of them. All other embodiments obtained by those skilled in the art based on the embodiments of the present disclosure without creative efforts are within the scope of the present disclosure.

Display devices may include pixels arranged in an array. Edge sub-pixels included in edge pixels may be partially blocked by a black bezel, so as to solve the problem of "edge leakage" of the display device. However, this also causes the luminance of the light emitted by the edge sub-pixels included in the edge pixels decreasing, causing a ratio among the luminance of the lights emitted by the respective sub-pixels included in the edge pixels failing to meet a requirement for white balance. Therefore, if the display device is used to display, for example, a white image, the color displayed by the edge pixels will be abnormal.

For example, the edge pixel may comprise a red sub-pixel, a green sub-pixel, and a blue sub-pixel. If the red sub-pixel is partially blocked, the luminance of the red light emitted by the red sub-pixel is relatively low when displaying a white image, thereby causing the color displayed by the edge pixel to be blue. If the green sub-pixel is partially blocked, the luminance of the green light emitted by the green sub-pixel is relatively low when the displaying the white image, thereby causing the color displayed by the edge pixel to be purple. If the blue sub-pixel is partially blocked, the luminance of the blue light emitted by the blue sub-pixel is a relatively low when displaying the white image, thereby causing the color displayed by the edge pixel to be yellow.

Figure 1:
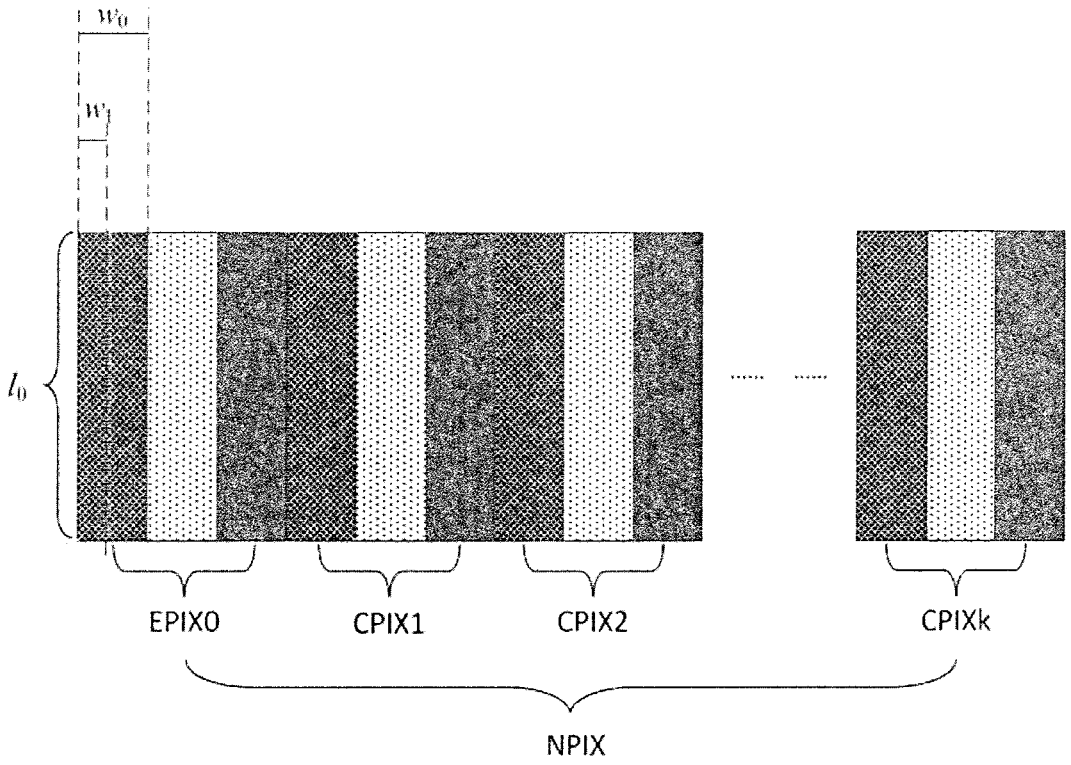
FIG. 1 shows a schematic diagram illustrating an arrangement of N pixels according to an embodiment of the present disclosure.
Figure 2:
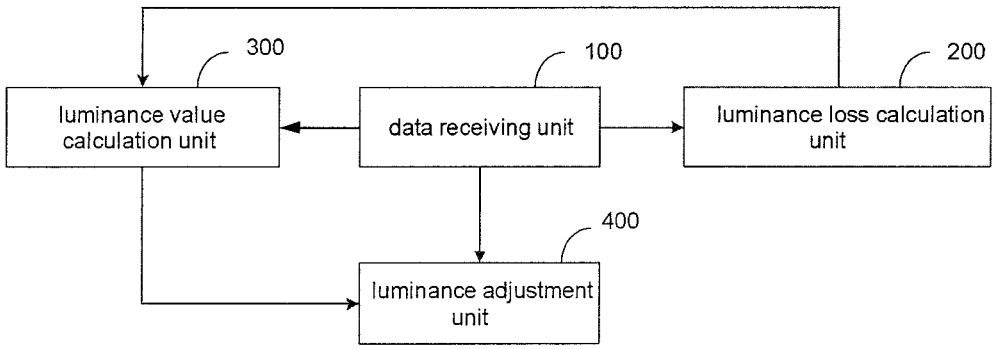
FIG. 2 shows a block diagram illustrating an example of a structure of a device for controlling luminance according to an embodiment of the present disclosure.
Figure 3:
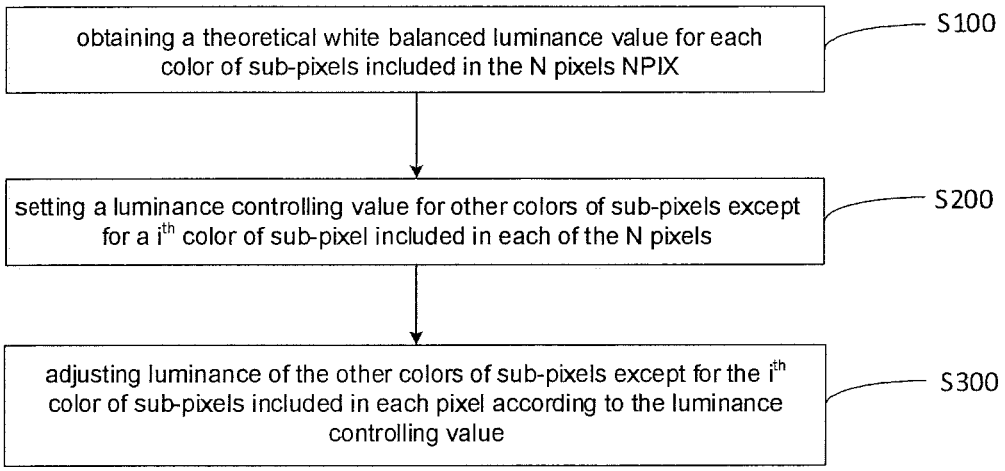
FIG. 3 shows a flowchart illustrating a method for controlling luminance according to an embodiment of the present disclosure.

Referring to FIGS. 1-3, the embodiments of the present disclosure provide a device for controlling luminance, which can be used not only in a liquid crystal display, but also in an organic electroluminescent display. The device for controlling luminance can comprise: a data receiving unit 100, configured to obtain a theoretical white balanced luminance value for each color of sub-pixel included in N pixels, wherein the N pixels are adjacent, and N is an integer greater than or equal to 1.

The device may further include a luminance value calculation unit 300 coupled to the data receiving unit 100 and configured to set a luminance controlling value for other colors of sub-pixels except for a $i^{th}$ color of sub-pixel included in each of the N pixels, according to the theoretical white balanced luminance value for each color of sub-pixel and a sum of the luminance loss values for the $i^{th}$ color of sub-pixels included in the N pixels NPIX, in response to the $i^{th}$ color of sub-pixel included in a $t^{th}$ pixel of the N pixels NPIX having a luminance loss, wherein t is an integer greater than or equal to 1 and less than or equal to N, and i is an integer greater than or equal to 1.

The luminance controlling device may further include a luminance adjustment unit 400 coupled to the data receiving unit 100 and the luminance value calculation unit 300 respectively and configured to adjust luminance of the other colors of sub-pixels according to the luminance controlling value, so that a ratio between the sum of the luminance values of the $i^{th}$ color of sub-pixels included in the N pixels and the sum of the adjusted luminance values of the other colors of sub-pixels except for the $i^{th}$ color of sub-pixels included in the N pixels NPIX is coincident with a white balanced luminance value ratio. Hereinafter, "displaying luminance" is also referred to as "actual luminance".

In the device for controlling luminance according to the embodiments of the present disclosure, the data receiving unit 100 obtains the theoretical white balanced luminance values for each color of sub-pixels included in the N pixels NPIX. If the $i^{th}$ color of sub-pixel included in the $t^{th}$ pixel of the N pixels NPIX has a luminance loss, the color displayed by the $t^{th}$ pixel may be abnormal during the displaying. Since the $i^{th}$ color of sub-pixel included in the $i^{th}$ pixel has a luminance loss, the sum of the luminance loss values of the $i^{th}$ color of sub-pixels included in the N pixels NPIX may be equal to the luminance loss value of the $i^{th}$ color of sub-pixel included in the $t^{th}$ pixel. Therefore, the luminance calculation unit may set the luminance controlling value for other colors of sub-pixels except for the $i^{th}$ color of sub-pixel included in each pixel, according to the theoretical white balanced luminance value for each color of sub-pixel included in each pixel and the sum of the luminance loss values for the $i^{th}$ color of sub-pixels included in the N pixels. Therefore, the luminance adjustment unit 400 may adjust luminance of the other colors of sub-pixels except for the $i^{th}$ color of sub-pixel included in each pixel by utilizing the luminance controlling value, so that the ratio between the sum of the luminance values of the $i^{th}$ color of sub-pixels included in the N pixels and the actual sum of the adjusted luminance values of the other colors of sub-pixels except for the $i^{th}$ color of sub-pixels included in the N pixels NPIX is coincident with a white balanced luminance value ratio. Although the ratio among the actual luminance values of the respective sub-pixels included in each pixel does not conform to the requirements for white balancing in a view of single pixel, causing the color displayed by this pixel being abnormal, such abnormal displaying of single pixel cannot be distinguished by a naked eye. Therefore, in the device for controlling luminance according to the embodiment of the present disclosure, it is possible to compensate the luminance loss for the $i^{th}$ color of sub-pixel included in the $t^{th}$ pixel by adjusting the luminance of each color of sub-pixels except for the $i^{th}$ color of sub-pixels included in the N pixels NPIX, thereby ensuring that the colors of the N pixels NPIX perceived by a user seems to be normal.

For example, in the display device, when N=1, the $t^{th}$ pixel is the only pixel. When the pixel is used as the edge pixel EPIX0, if the $i^{th}$ color of sub-pixel included in the edge pixel EPIX0 is blocked by the bezel or other shading object, the luminance of the respective sub-pixels included in the edge pixel EPIX0 can be adjusted to conform to the white balanced luminance ratio by reducing the luminance of other colors of sub-pixels except for the $i^{th}$ color of sub-pixel included in this pixel, thereby ensuring that the color displayed by the edge pixel EPIX0 is normal when displaying the white image. At the same time, the luminance of the edge pixel EPIX0 may differ from the luminance of other pixels.

When N≥2 and the $t^{th}$ pixel is the edge pixel EPIX0, if the $i^{th}$ color of sub-pixel included in the edge pixel EPIX0 is blocked by the bezel or other shading object, the color displayed by the N pixels NPIX seems normal to the user when displaying the white image by reducing the luminance of each color of sub-pixels except for the $i^{th}$ color of sub-pixels included in N pixels. At this time, since the reduction for the luminance of each color of sub-pixels except for the $i^{th}$ color of sub-pixels included in N pixels NPIX is relatively small, it is ensured that the actual luminance of the N pixels NPIX will not significantly differ from the luminance of other pixels, thereby improving the uniformity for the luminance of the picture displayed by the display device.

In some embodiments, the device for controlling luminance according to the embodiment of the present disclosure can be applied not only in the case that the edge sub-pixel included in the edge pixel EPIX0 is partially blocked, but also in the case that the sub-pixel included in any pixel of the display device is partially blocked.

In some embodiments, as shown in FIG. 1, the N pixels NPIX are disposed adjacent to each other, and the N pixels NPIX are arranged along a direction away from the bezel. Thus, the N pixels NPIX are arranged along the direction from the edge of a display panel toward the center.

For example, as shown in FIG. 1, among the array-arranged pixels included in the display device, the outermost column of the pixels may experience a color abnormality when displaying the white image. Therefore, the N pixels NPIX are arranged along the direction from the edge of the display device toward the center. It is possible to compensate the luminance of the first color of sub-pixel included in the edge pixel EPIX0 by using the other colors of sub-pixels except for the first color of sub-pixels in the N pixels NPIX.

The outermost column of pixels will experience the color abnormality when displaying a white image. Therefore, the N pixels NPIX are made to be arranged along a row direction from the edge of the display device to the center, so as to compensate the luminance of the first color of sub-pixel included in the edge pixels EPIX0 by using the other colors of sub-pixels except for the first colors of sub-pixels included in the N pixels NPIX.

For example, three pixels are arranged in one row, and the first pixel, the second pixel, and the third pixel each include a red sub-pixel, a green sub-pixel, and a blue sub-pixel. The first pixel EPIX0 is defined as an edge pixel, and the red sub-pixel included in the first pixel is blocked. When the device for controlling luminance is used to compensate the luminance of the red light emitted by the red sub-pixel included in the first pixel, the compensation can be performed in the following three ways.

In the first compensation example, N=1, and the luminance of the green light and the blue light respectively emitted by the green sub-pixel and the blue sub-pixel included in the first pixel is reduced according to the luminance loss of the red light emitted by the red sub-pixel included in the first pixel EPIX0, ensuring that the ratio among the actual luminance of the red light emitted by the red sub-pixel, the actual luminance of the green light emitted by the green sub-pixel, and the actual luminance of the blue light emitted by the blue sub-pixel conforms to the white balanced luminance ratio. At this time, when the row of pixels shown in FIG. 1 emits white light, the light emitted by the first pixel does not have any color cast, but has a luminance smaller than the light emitted by the second pixel and the third pixel.

In the second compensation example, N=2, and the luminance of the green light and the blue light respectively emitted by the green sub-pixels and the blue sub-pixels included in the first pixel EPIX0 and the second pixel CPIX1 may be reduced, ensuring that the ratio among the sum of the actual luminance values of the red light emitted by the red sub-pixels included in the first pixel and the second pixel, the sum of the actual luminance values of the green light emitted by the green sub-pixels included in the first pixel and the second pixel, and the sum of the actual luminance values of the blue light emitted by the blue sub-pixels included in the first pixel and the second pixel conforms to the white balanced luminance ratio. This enables to satisfy the white balance requirement in visual perception when the row of pixels shown in FIG. 1 emits white light. Therefore, when the row of pixels shown in FIG. 1 emits white light, the problem of color abnormality is somewhat alleviated. Although the actual luminance value of the red light emitted by the red sub-pixel included in the first pixel, the actual luminance value of the green light emitted by the green sub-pixel included in the first pixel, and the actual luminance value of the blue light emitted by the blue sub-pixel included in the first pixel do not meet the requirement for white balanced luminance, this cannot be distinguished by the naked eye since the size of the pixels is small. Therefore, when the row of pixels shown in FIG. 1 emits white light, the color of the light emitted by the first pixel may experience a color cast, but the problem of color abnormality can be alleviated.

In the third compensation example, N=3, and the luminance of the green light and the blue light respectively emitted by the green sub-pixels and the blue sub-pixels included in the first pixel EPIX0, the second pixel CPIX1 and the third pixel CPIX2 may be reduced, ensuring that the ratio among the sum of the actual luminance values of the red light emitted by the red sub-pixels included in the first pixel, the second pixel and the third pixel, the sum of the actual luminance values of the green light emitted by the green sub-pixels included in the first pixel, the second pixel and the third pixel, and the sum of the actual luminance values of the blue light emitted by the blue sub-pixels included in the first pixel, the second pixel and the third pixel conforms to the white balanced luminance ratio. This enables to satisfy the white balance requirement in visual perception when the row of pixels shown in FIG. 1 emits white light. Therefore, when the row of pixels shown in FIG. 1 emits white light, the problem of color abnormality is somewhat alleviated. Although the actual luminance value of the red light emitted by the red sub-pixel included in the first pixel, the actual luminance value of the green light emitted by the green sub-pixel included in the first pixel, and the actual luminance value of the blue light emitted by the blue sub-pixel included in the first pixel do not meet the requirement for white balanced luminance requirement, this cannot be distinguished by the naked eye since the size of the pixels is small. Therefore, when the row of pixels shown in FIG. 1 emits white light, the color of the light emitted by the first pixel may experience a color cast, but the display of this row of pixels seem to be normal.

It is seen from the above three compensation examples that as the number of pixels participating in the luminance compensation increases, the luminance reduction ratio of the green sub-pixel and the blue sub-pixel included in each pixel reduces, making the ratio among the actual luminance of the red light emitted by the red sub-pixel, the actual luminance of the green light emitted by the green sub-pixel, and the actual luminance of the blue light emitted by the blue sub-pixel include in each pixel is closer to the luminance ratio for the white balanced light. At this time, when the white light is emitted, the color abnormalities of the second pixel and the third pixel participating in the luminance compensation can be negligible, and the luminance loss for each pixel is approximate to each other, ensuring a better uniformity for the luminance of the pixels when emitting white light.

In some embodiments, in order to make the ratio among the sum of the actual luminance values of the $i^{th}$ color of sub-pixels included in the N pixels and the sum of the actual luminance values of each color of sub-pixels except for the $i^{th}$ color of sub-pixels included in the N pixels NPIX to conform to the white balanced luminance ratio, the light emitted by each colors of the sub-pixels included in the N pixels NPIX should meet at least one of the following conditions.

First, the ratio between the luminance controlling value and the theoretical white balanced luminance value for each color of sub-pixel except for the $i^{th}$ color of sub-pixel in each pixel is equal to the ratio between the sum of the luminance loss values and the sum of the theoretical white balanced luminance values for the $i^{th}$ color of sub-pixels included in the N pixels, such that the ratio among the actual sum of the luminance values of each color of sub-pixels except for the $i^{th}$ color of sub-pixels included in the N pixels is equal to the theoretical white balanced luminance value ratio of each color of sub-pixels except for the $i^{th}$ color of sub-pixel included in the N pixel.

Secondly, the ratio between a sum of the luminance controlling values and the sum of the theoretical white balanced luminance values for each of the other colors of sub-pixels except for the $i^{th}$ color of sub-pixel included in the N pixel is equal to a ratio between the luminance loss values and the sum of the theoretical white balanced luminance values for the $i^{th}$ color of sub-pixels included in the N pixels NPIX, such that the ratio among the actual sum of the luminance values of each color of sub-pixels except for the $i^{th}$ color of sub-pixels included in the N pixels NPIX is equal to the theoretical white balanced luminance value ratio of each color of sub-pixels except for the $i^{th}$ color of sub-pixel included in the N pixel NPIX.

In addition, the luminance adjustment unit 400 is further configured to adjust the luminance of other colors of sub-pixels except for the $i^{th}$ color of sub-pixel included in each pixel, such that at least one of the following conditions is satisfied: a ratio among the actual luminance values of the other colors of sub-pixels except for the $i^{th}$ color of sub-pixel included in each pixel being equal to the theoretical white balanced luminance value ratio of the other colors of sub-pixels; a ratio among the actual luminance values of the same color of sub-pixels except for the $i^{th}$ color of sub-pixels included in the N pixels NPIX being equal to the theoretical white balanced luminance value ratio of the same color of sub-pixels.

Figure 4:
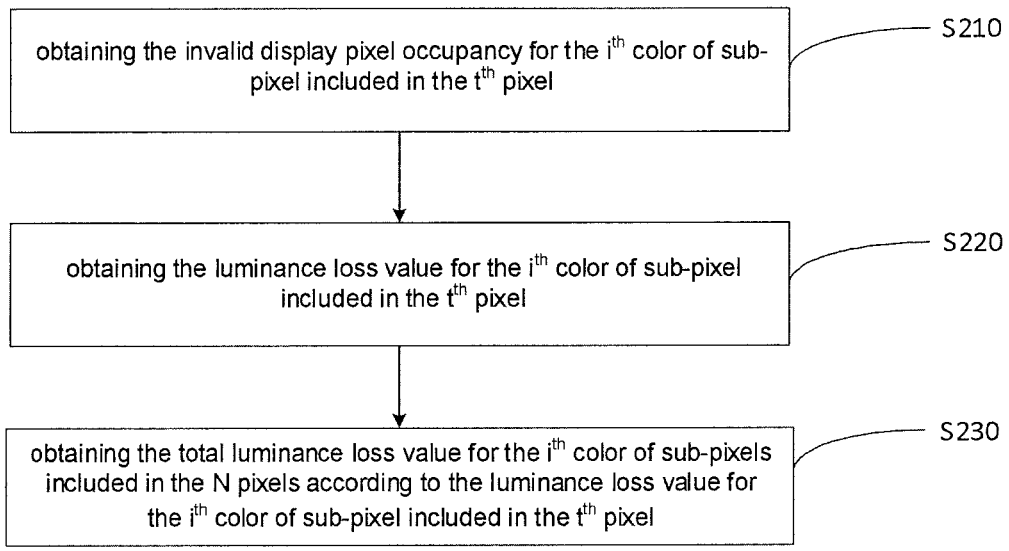
FIG. 4 shows a flowchart of calculating a sum of the luminance loss value for an $i^{th}$ color of sub-pixels included in N pixels according to an embodiment of the present disclosure.

In some embodiments, as shown in FIG. 1, FIG. 2 and FIG. 4, the $i^{th}$ color of sub-pixel included in the $t^{th}$ pixel has an invalid display area with a width of $w_1$. The device for controlling luminance further includes a luminance loss calculation unit 200 coupled to the data receiving unit 100 and the luminance calculation unit 300 respectively. The luminance loss calculation unit 200 may be configured to, for example, before obtaining the luminance controlling value for the other colors of sub-pixels except for the $i^{th}$ color of sub-pixel included in each pixel according to the theoretical balanced luminance value of each color of sub-pixel included in each pixel and the sum of the luminance loss values for the $i^{th}$ color of sub-pixels included in the N pixels NPIX, obtain an invalid display pixel occupancy $$\frac{x}{a}$$

for the $i^{th}$ color of sub-pixel included in the V" pixel according to an area x of an invalid display region and the area a of the theoretical display region of the $i^{th}$ color of sub-pixel included in the V" pixel; obtain the luminance loss value $\Delta L_{ti}$ for the $i^{th}$ color of sub-pixel included in the $t^{th}$ pixel, according to the invalid display pixel occupancy $$\frac{x}{a}$$

and me theoretical white balanced luminance value for the $i^{th}$ color of sub-pixel included in the $t^{th}$ pixel, wherein $$\Delta L_{ti} = \frac{x}{a} L_{ti};$$

obtain the sum of the luminance loss values $\Delta L_i$ for the $i^{th}$ color of sub-pixels included in the N pixels according to the luminance loss value $\Delta L_{ti}$ for the $i^{th}$ color of sub-pixel included in the $t^{th}$ pixel.

In some embodiments, considering that the size of the pixel cannot be distinguished by the naked eye, it is reasonable to deem that the $i^{th}$ color of sub-pixel included in the $t^{th}$ pixel may have a luminance loss equivalent to the sum of the luminance loss values of the $i^{th}$ color of sub-pixels included in the N pixels NPIX participating in the luminance compensation. Based on this, the sum of the luminance loss values of the $i^{th}$ color of sub-pixels included in the N pixels NPIX is $$\Delta L_i = \frac{x}{a} L_{ti}.$$

In some embodiments, the ratio between the luminance controlling value $\Delta L_{js}$ and the theoretical white balanced luminance value $L_{js}$ for each color of sub-pixel except for the $i^{th}$ color of sub-pixel included in each pixel is equal to the ratio between the sum of the luminance loss values $\Delta L_i$ and the sum of the theoretical white balanced luminance values $L_i$ for the $i^{th}$ color of sub-pixels included in the N pixels, which can be expressed as:

$$\frac{\frac{x}{a} L_{ti}}{L_i} = \frac{\Delta L_{js}}{L_{js}}.$$

Since $$L_i = \sum_{j=1}^{N} L_{ji},$$

the luminance controlling values for other colors of sub-pixels except for the $i^{th}$ color of sub-pixel included in each pixel are:

$$\Delta L_{js} = \frac{\frac{x}{a} L_{ti}}{\sum_{j=1}^{N} L_{ji}} L_{js},$$

wherein $$\sum_{j=1}^{N} L_{ji}$$

indicates for the sum of the theoretical white balanced luminance values for the $i^{th}$ color of sub-pixels included in the N pixels, $L_{ji}$ indicates for the theoretical white balanced luminance value for the $i^{th}$ color of sub-pixel included in a $j^{th}$ pixel of the N pixels, $L_{js}$ indicates for the theoretical white balanced luminance value for a $s^{th}$ color of sub-pixel included in the $j^{th}$ pixel, and $\Delta L_{js}$ indicates for a luminance controlling parameter for the $s^{th}$ color of sub-pixel included in the $j^{th}$ pixel, wherein j is an index number of the pixel which is greater than or equal to 1 and less than or equal to N, and s is an index number of other colors of sub-pixels except for the $i^{th}$ color of sub-pixel included in each pixel, and is an integer greater than 0 and not equal to i.

It can be seen that in the case where the number N of pixels is constant, the sum of the theoretical white balanced luminance values $$\sum_{j=1}^{N} L_{ji}$$

and the sum of the luminance loss values $$\frac{x}{a} L_{ti}$$

for the $i^{th}$ color of sub-pixels included in the N pixels NPIX are both constant. Therefore, the ratio between the theoretical white balanced luminance value and the actual luminance value for each of the other colors of sub-pixels except for the $i^{th}$ color of sub-pixel included in each pixel is the same, i.e.

$$\frac{\frac{x}{a} L_{ti}}{\sum_{j=1}^{N} L_{ji}}.$$

Based on this, the luminance calculation unit 300 can obtain the sum of the theoretical white balanced luminance values for the $i^{th}$ color of sub-pixels included in the N pixels NPIX, according to the theoretical white balanced luminance values for the $i^{th}$ color of sub-pixel included in each of the N pixels NPIX; obtain a luminance reduction rate $\eta_{js}$ for the other colors of sub-pixels except for the $i^{th}$ color of sub-pixel included in each pixel, according to the sum of the theoretical white balanced luminance values and the sum of the luminance loss values for the $i^{th}$ color of sub-pixels included in the N pixels; and obtain the luminance controlling value for the other colors of sub-pixels except for the $i^{th}$ color of sub-pixel included in each pixel, according to the luminance reduction rate $1\eta_{js}$ and the theoretical whites balanced luminance value for the other colors of sub-pixels except for the $i^{th}$ color of sub-pixel included in each pixel.

The luminance reduction rate of the other colors of sub-pixels except for the $i^{th}$ color of sub-pixel included in each pixel is:

$$\eta_{js} = \frac{\frac{x}{a} L_{1i}}{\sum_{j=1}^{N} L_{ji}},$$

wherein j is the index number of the pixel, and s is an index number of other colors of sub-pixels except for the $i^{th}$ color of sub-pixel included in each pixel, and is an integer greater than 0 and not equal to i. It can be seen that by sharing the luminance loss value for the $i^{th}$ sub-pixel included in the $t^{th}$ pixel via the $i^{th}$ sub-pixels included in the N pixels NPIX, it is possible to reduce the luminance reduction rate for the other colors of sub-pixels except for the $i^{th}$ color of sub-pixels included in the N pixels NPIX in a subsequent luminance reduction process.

In some embodiments, a specific controlling strategy for the luminance controlling device according to the embodiment of the present disclosure during an operation is described in detail. As shown in FIG. 1, it is assumed that there are N pixels NPIX, each of which includes a red sub-pixel, a green sub-pixel, and a blue sub-pixel. The shape and size of the red sub-pixel, the green sub-pixel, and the blue sub-pixel are same (in terms of area).

For example, the red sub-pixel, the green sub-pixel, and the blue sub-pixel included in each pixel are rectangles with the same length and width. The rectangle has a width of $w_0$ and a length of $l_0$. One pixel is defined as the edge pixel EPIX0, and (N−1) pixels are defined as the compensation pixel, N−1=k. The red sub-pixel included in the edge pixel EPIX0 is blocked by the bezel to have a width $w_1$. In order to describe the following procedure clearly, the subscript indicating the edge pixel EPIX0 is defined as 0, and the subscript indicating the N−1 compensation pixels is defined as 1 to k.

The data receiving unit 100 can obtain the following related theoretical white balanced luminance values, which are relative values expressed by gray scale values, ranging from 1 to 255.

The theoretical white balanced luminance value for the red sub-pixel included in the edge pixel is $L_{0R}$, the theoretical white balanced luminance value for the green sub-pixel included in the edge pixel is $L_{0G}$, and the theoretical white balanced luminance value for the blue sub-pixel included in the edge pixel is $L_{0B}$.

The theoretical white balanced luminance value for the red sub-pixel included in the first compensation pixel CPIX1 is $L_{1R}$, the theoretical white balanced luminance value for the green sub-pixel included in the first compensation pixel CPIX1 is $L_{1G}$, and the theoretical white balanced luminance value for the blue sub-pixel included in the first compensation pixel CPIX1 is $L_{1B}$.

The theoretical white balanced luminance value for the red sub-pixel included in the second compensation pixel CPIX2 is $L_{2R}$, the theoretical white balanced luminance value for the green sub-pixel included in the second compensation pixel CPIX2 is $L_{2G}$, and the theoretical white balanced luminance value for the blue sub-pixel included in the second compensation pixel CPIX2 is $L_{2B}$.

The theoretical white balanced luminance value for the red sub-pixel included in the $k^{th}$ compensation pixel CPIXk is $L_{kR}$, the theoretical white balanced luminance value for the green sub-pixel included in the $k^{th}$ compensation pixel CPIXk is $L_{kG}$, and the theoretical white balanced luminance value for the blue sub-pixel included in the $k^{th}$ compensation pixel CPIXk is $L_{kB}$.

In order to simplify the luminance controlling values for the green sub-pixels and the blue sub-pixels included in each pixel, the above data can be processed in the following manner.

$$L_{1R}/L_{0R}=K_{1R}\ L_{2R}/L_{0R}=K_{2R}\ldots L_{kR}/L_{0R}=K_{kR}$$

$$L_{1G}/L_{0G}=K_{1G}\ L_{2G}/L_{0G}=K_{2G}\ldots L_{kG}/L_{0G}=K_{kG}$$

$$L_{1B}/L_{0B}=K_{1B}\ L_{2B}/L_{0B}=K_{2B}\ldots L_{kB}/L_{0B}=K_{kB}$$

The sum of the theoretical white balanced luminance values $L_R$ for the red sub-pixels included in the N pixels NPIX is expressed by:

$$L_R=L_{0R}+L_{1R}+L_{2R}+\ldots+L_{kR}=L_{0R}(1+K_{1R}+K_{2R}+\ldots+K_{kR}).$$

The sum of the theoretical white balanced luminance values $L_G$ for the green sub-pixels included in the N pixels NPIX is expressed by:

$$L_G=L_{0G}+L_{1G}+L_{2G}+\ldots+K_{kG}=L_{0G}(1+K_{1G}+K_{2G}+\ldots+K_{kG})$$

The sum of the theoretical white balanced luminance values $L_B$ for the blue sub-pixels included in the N pixels NPIX is expressed by:

$$L_B=L_{0B}+L_{1B}+L_{2B}+\ldots L_{kB}=L_{0B}(1+K_{1B}+K_{2B}+\ldots+K_{kB})$$

By setting the luminance loss value $\Delta L_{0R}$ for the red sub-pixel included in the edge pixel EPIX0 as the luminance loss value $\Delta L_R$ for the red sub-pixels included in the N pixels NPIX, the luminance loss value $\Delta L_R$ for the red sub-pixels included in the N pixels NPIX is enabled to be equal to the luminance loss value $\Delta L_{0R}$ for the red sub-pixel included in the edge pixel EPIX0. Since $$\Delta L_{0R}=\frac{l_0w_1}{L_0w_0}L_{0R},$$

the luminance loss value $\Delta L_R$ for the red sub-pixels included in the N pixels NPIX is $$\Delta L_R=\frac{l_0w_1}{L_0w_0}L_{0R}=\frac{x}{a}L_{0R}.$$

When the luminance controlling device according to the embodiment of the present disclosure is applied to the display device to control the luminance, the ratio between the sum of the luminance controlling values $\Delta L_B$ and the sum of the theoretical white balanced luminance values $L_B$ for the green sub-pixels included in the N pixels NPIX and the ratio between the sum of the luminance controlling values $\Delta L_G$ and the sum of the theoretical white balanced luminance values $L_G$ for the blue sub-pixels included in the N pixels NPIX are the same as the ratio between the sum of the luminance loss values and the sum of the theoretical white balanced luminance values for the red sub-pixels included in the N pixels NPIX. The sum of the luminance loss values for the red sub-pixels included in the N pixels NPIX is equal to the loss value for the red sub-pixel included in the edge pixel EPIX0, which can be expressed by:

$$\frac{\Delta L_B}{L_B}=\frac{\Delta L_G}{L_G}=\frac{\Delta L_R}{L_R}=\frac{\frac{x}{a}L_{0R}}{L_R}=\frac{\frac{x}{a}L_{0R}}{L_{0R}(1+K_{1R}+K_{2R}+\ldots+K_{kR})}=\frac{x}{a(1+K_{1R}+K_{2R}+\ldots+K_{kR})}.$$

That is, $$\Delta L_G=L_G\frac{x}{a(1+K_{1R}+K_{2R}+\ldots+K_{kR})}=\frac{x(1+K_{1G}+K_{2G}+\ldots+K_{kG})}{a(1+K_{1R}+K_{2R}+\ldots+K_{kR})}L_{0G},$$

and $$\Delta L_B=L_B\frac{x}{a(1+K_{1R}+K_{2R}+\ldots+K_{kR})}=\frac{x(1+K_{1B}+K_{2B}+\ldots+K_{kB})}{a(1+K_{1R}+K_{2R}+\ldots+K_{kR})}L_{0B}.$$

Since $\Delta L_B=\Delta L_{0B}+\Delta L_{1B}+\Delta L_{2B}+\ldots+\Delta L_{kB}$ and $\Delta L_G=\Delta L_{0G}+\Delta L_{1G}+\Delta L_{2G}+\ldots+L_{kG}$, it can be derived that:

$$\Delta L_{0G}+\Delta L_{1G}+\Delta L_{2G}+\ldots+\Delta L_{kG}=\frac{x(1+K_{1G}+K_{2G}+\ldots+K_{kG})}{a(1+K_{1R}+K_{2R}+\ldots+K_{kR})}L_{0G},\text{ and}$$

$$\Delta L_{0B}+\Delta L_{1B}+\Delta L_{2B}+\ldots+\Delta L_{kB}=\frac{x(1+K_{1B}+K_{2B}+\ldots+K_{kB})}{a(1+K_{1R}+K_{2R}+\ldots+K_{kR})}L_{0B}.$$

wherein $\Delta L_{0G}$ indicates for the luminance controlling value of the green sub-pixel included in the edge pixel EPIX0;

$\Delta L_{0B}$ indicates for the luminance controlling value of the blue sub-pixel included in the edge pixel EPIX0;

$\Delta L_{1G}$ indicates for the luminance controlling value of the green sub-pixel included in the first compensation pixel CPIX1;

$\Delta L_{1B}$ indicates for the luminance controlling value of the blue sub-pixel included in the first compensation pixel CPIX1;

$\Delta L_{1B}$ indicates for the luminance controlling value of the green sub-pixel included in the second compensation pixel CPIX2;

$\Delta L_{2B}$ indicates for the luminance controlling value of the blue sub-pixel included in the second compensation pixel CPIX2;

. . .

$\Delta L_{kG}$ indicates for the luminance controlling value of the green sub-pixel included in the $k^{th}$ compensation pixel CPIXk; and $\Delta L_{kB}$ indicates for the luminance controlling value of the blue sub-pixel included in the $k^{th}$ compensation pixel CPIXk.

When the ratio among the actual luminance values for the green sub-pixels included in the N pixels NPIX is the same as the theoretical white balanced luminance ratio for the green sub-pixels included in the N pixels NPIX and the ratio among the actual luminance values for the blue sub-pixels included in the N pixels NPIX is the same as the theoretical white balanced luminance ratio for the blue sub-pixels included in the N pixels NPIX, the above luminance controlling value can be expressed as:

$$\frac{\Delta L_{1G}}{\Delta L_{0G}}=\frac{L_{1G}}{L_{0G}}=K_{1G}$$

$$\frac{\Delta L_{2G}}{\Delta L_{0G}}=\frac{L_{2G}}{L_{0G}}=K_{2G}\ \ldots\ \frac{\Delta L_{kG}}{\Delta L_{0G}}=\frac{L_{kG}}{L_{0G}}=K_{kG},$$

Thus, $$\Delta L_{1G}=\frac{L_{1G}}{L_{0G}}\Delta L_{0G}$$

$$\Delta L_{2G}=\frac{L_{2G}}{L_{0G}}\Delta L_{0G}\ \ldots\ \Delta L_{kG}=\Delta L_{0G}\frac{L_{kG}}{L_{0G}}.$$

Since $\frac{\Delta L_{1B}}{\Delta L_{0B}}=\frac{L_{1B}}{L_{0B}}=K_{1B}$ $$\frac{\Delta L_{2B}}{\Delta L_{0B}}=\frac{L_{2B}}{L_{0B}}=K_{2B}\ \ldots\ \frac{\Delta L_{kB}}{\Delta L_{0B}}=\frac{L_{kB}}{L_{0B}}=K_{kB},$$

$$\Delta L_{1B}=\frac{L_{1B}}{L_{0B}}\Delta L_{0B}$$

$$\Delta L_{1B}=\frac{L_{1B}}{L_{0B}}\Delta L_{0B}\ \ldots\ \Delta L_{kB}=\frac{L_{kB}}{L_{0B}}\Delta L_{0B}.$$

Further, $$\text{since } \Delta L_{0G} + \Delta L_{1G} + \Delta L_{2G} + \ldots + \Delta L_{kG} = \frac{x(1 + K_{1G} + K_{2G} + \ldots + K_{kG})}{a(1 + K_{1R} + K_{2R} + \ldots + K_{kR})} L_{0G}$$

$$\text{and } \Delta L_{0B} + \Delta L_{1B} + \Delta L_{2B} + \ldots + \Delta L_{kB} = \frac{x(1 + K_{1B} + K_{2B} + \ldots + K_{kB})}{a(1 + K_{1R} + K_{2R} + \ldots + K_{kR})} L_{0B},$$

$$\Delta L_{0G} + K_{1G}\Delta L_{0G} + K_{2G}\Delta L_{0G} + \ldots + K_{kG}\Delta L_{0G} = \Delta L_{0G}(1 + K_{1G} + K_{2G} + \ldots + K_{kG}) = \frac{x(1 + K_{1G} + K_{2G} + \ldots + K_{kG})}{a(1 + K_{1R} + K_{2R} + \ldots + K_{kR})} L_{0G},$$

and $$\Delta L_{0B} + K_{1B}\Delta L_{0B} + K_{2B}\Delta L_{0B} + \ldots + K_{kB}\Delta L_{0B} = \Delta L_{0B}(1 + K_{1B} + K_{2B} + \ldots + K_{kB}) = \frac{x(1 + K_{1B} + K_{2B} + \ldots + K_{kB})}{a(1 + K_{1R} + K_{2R} + \ldots + K_{kR})} L_{0B}.$$

Thus, the luminance controlling value for the green sub-pixel included in the edge pixel EPIX0 is expressed as:

$$\Delta L_{0G} = \frac{x}{a(1 + K_{1R} + K_{2R} + \ldots + K_{kR})} L_{0G}.$$

The luminance controlling value for the blue sub-pixel included in the edge pixel EPIX0 is expressed as:

$$\Delta L_{0B} = \frac{x}{a(1 + K_{1R} + K_{2R} + \ldots + K_{kR})} L_{0B}.$$

The luminance controlling value for the green sub-pixel included in the first compensation pixel CPIX1 is expressed as:

$$\Delta L_{1G} = \frac{L_{1G}}{L_{0G}} \Delta L_{0G} = \frac{L_{1G}}{L_{0G}} \frac{x}{a(1 + K_{1R} + K_{2R} + \ldots + K_{kR})} L_{0G} = \frac{x}{a(1 + K_{1R} + K_{2R} + \ldots + K_{kR})} L_{1G},$$

that is, $$\Delta L_{1G} = \frac{x}{a(1 + K_{1R} + K_{2R} + \ldots + K_{kR})} L_{1G} = \eta_{1G} L_{1G}.$$

The luminance controlling value for the blue sub-pixel included in the first compensation pixel CPIX1 is expressed as:

$$\Delta L_{1B} = \frac{L_{1B}}{L_{0B}} \Delta L_{0B} = \frac{L_{1B}}{L_{0B}} \frac{x}{a(1 + K_{1R} + K_{2R} + \ldots + K_{kR})} L_{0B} = \frac{x}{a(1 + K_{1R} + K_{2R} + \ldots + K_{kR})} L_{1B},$$

that is, $$\Delta L_{1B} = \frac{x}{a(1 + K_{1R} + K_{2R} + \ldots + K_{kR})} L_{1B} = \eta_{1B} L_{1B}.$$

The luminance controlling value for the green sub-pixel included in the second compensation pixel CPIX2 is expressed as:

$$\Delta L_{2G} = \frac{L_{2G}}{L_{0G}} \Delta L_{0G} = \frac{L_{2G}}{L_{0G}} \frac{x}{a(1 + K_{1R} + K_{2R} + \ldots + K_{kR})} L_{0G} = \frac{x}{a(1 + K_{1R} + K_{2R} + \ldots + K_{kR})} L_{2G},$$

that is, $$\Delta L_{2G} = \frac{x}{a(1 + K_{1R} + K_{2R} + \ldots + K_{kR})} L_{2G} = \eta_{2G} L_{2G}.$$

The luminance controlling value for the blue sub-pixel included in the second compensation pixel CPIX2 is expressed as:

$$\Delta L_{2B} = \frac{L_{2B}}{L_{0B}} \Delta L_{0B} = \frac{L_{2B}}{L_{0B}} \frac{x}{a(1 + K_{1R} + K_{2R} + \ldots + K_{kR})} L_{0B} = \frac{x}{a(1 + K_{1R} + K_{2R} + \ldots + K_{kR})} L_{2B},$$

that is, $$\Delta L_{2B} = \frac{x}{a(1 + K_{1R} + K_{2R} + \ldots + K_{kR})} L_{2B} = \eta_{2B} L_{2B}.$$

The luminance controlling value for the green sub-pixel included in the $k^{th}$ compensation pixel CPIXk is expressed as:

$$\Delta L_{kG} = \frac{L_{kG}}{L_{0G}} \Delta L_{0G} = \frac{L_{kG}}{L_{0G}} \frac{x}{a(1 + K_{1R} + K_{2R} + \ldots + K_{kR})} L_{0G} = \frac{x}{a(1 + K_{1R} + K_{2R} + \ldots + K_{kR})} L_{kG},$$

that is, $$\Delta L_{kG} = \frac{x}{a(1 + K_{1R} + K_{2R} + \ldots + K_{kR})} L_{kG} = \eta_{kG} L_{kG}.$$

The luminance controlling value for the blue sub-pixel included in the $k^{th}$ compensation pixel CPIXk is expressed as:

$$\Delta L_{kB} = \frac{L_{kB}}{L_{0B}} \Delta L_{0B} = \frac{L_{kB}}{L_{0B}} \frac{x}{a(1 + K_{1R} + K_{2R} + \ldots + K_{kR})} L_{0B} = \frac{x}{a(1 + K_{1R} + K_{2R} + \ldots + K_{kR})} L_{kB},$$

that is, $$\Delta L_{kB} = \frac{x}{a(1 + K_{1R} + K_{2R} + \ldots + K_{kR})} L_{kB} = \eta_{kB} L_{kB}.$$

As shown in FIG. 3, an embodiment of the present disclosure further provides a method for controlling luminance comprising the following steps.

The method comprises in step S100, obtaining a theoretical white balanced luminance value for each color of sub-pixels included in the N pixels NPIX, wherein N is an integer greater than or equal to 1.

The method further comprises in step S200, setting a luminance controlling value for other colors of sub-pixels except for a $i^{th}$ color of sub-pixel included in each of the N pixels, according to the theoretical white balanced luminance value for each color of sub-pixel and a sum of the luminance loss values for the $i^{th}$ color of sub-pixels included in the N pixels NPIX, in response to the $i^{th}$ color of sub-pixel included in a $t^{th}$ pixel of the N pixels having a luminance loss, wherein t is an integer greater than or equal to 1 and less than or equal to N, and i is an integer greater than or equal to 1.

The method further comprises in step S300, adjusting luminance of the other colors of sub-pixels according to the luminance controlling value, so that a ratio among the sum of the luminance values of the $i^{th}$ color of sub-pixels included in the N pixels and the sum of the adjusted luminance values of the other colors of sub-pixels except for the $i^{th}$ color of sub-pixels included in the N pixels NPIX is coincident with a white balanced luminance value ratio.

The method for controlling luminance according to the embodiment of the present disclosure is provided for compensating the luminance for any sub-pixel included in any pixel of the display device. The pixel may be the edge pixel EPIX0 or other pixels.

In some embodiments, when performing the luminance adjustment, the luminance controlling value is set for each of the other colors of sub-pixels except for the $i^{th}$ sub-pixel included in each pixel, so as to satisfy that:

the ratio between the luminance controlling value and the theoretical white balanced luminance value for each of the other colors of sub-pixels except for the $i^{th}$ color of sub-pixel included in each pixel is equal to the ratio between the sum of the luminance loss values and a sum of the theoretical white balanced luminance values for the $i^{th}$ color of sub-pixels included in the N pixels NPIX.

In some embodiments, when performing the luminance adjustment, the luminance controlling value is set for each of the other colors of sub-pixels except for the $i^{th}$ sub-pixel included in each pixel, so as to satisfy that:

the ratio between a sum of the luminance controlling values and the sum of the theoretical white balanced luminance values for each of the other colors of sub-pixels except for the $i^{th}$ color of sub-pixel included in the N adjacent pixel is equal to the ratio between the sum of the luminance loss values and the sum of the theoretical white balanced luminance values for the $i^{th}$ color of sub-pixels included in the N pixels.

In some embodiments, the luminance is adjusted, such that the luminance of each color of sub-pixel included in each pixel satisfies that:

the ratio among the adjusted luminance values of the other colors of sub-pixels except for the $i^{th}$ color of sub-pixel included in each pixel is equal to the theoretical white balanced luminance value ratio of the other colors of sub-pixels.

In some embodiments, the luminance is adjusted, such that the luminance of each color of sub-pixel included in each pixel satisfies that:

the ratio among the adjusted luminance values of the same color of sub-pixels except for the $i^{th}$ color of sub-pixels included in the N pixels NPIX is equal to the theoretical white balanced luminance value ratio of the same color of sub-pixels.

In some embodiments, as shown in FIG. 1, FIG. 3 and FIG. 4, the $i^{th}$ color of sub-pixel included in the $t^{th}$ pixel has an invalid display region. The step 200 of setting the luminance controlling value for the other colors of sub-pixels except for the $i^{th}$ color of sub-pixel included in each pixel may further include the following steps.

In step S210, the invalid display pixel occupancy $$\frac{x}{a}$$

for the $i^{th}$ color of sub-pixel included in the $t^{th}$ pixel is obtained according to an area x of the invalid display region and the area of a theoretical display region a for the $i^{th}$ color of sub-pixel included in the $t^{th}$ pixel.

In step S220, the luminance loss value $\Delta L_{ti}$ for the $i^{th}$ color of sub-pixel included in the $t^{th}$ pixel is obtained according to the invalid display pixel occupancy $$\frac{x}{a}$$

and the theoretical white balanced luminance value $L_{tia}$ for the $i^{th}$ color of sub-pixel, wherein $$\Delta L_{ti} = \frac{x}{a} L_{ti}.$$

In step S230, the sum of the luminance loss values $\Delta L_i$ for the $i^{th}$ color of sub-pixels included in the N pixels is obtained according to the luminance loss values $\Delta L_{ti}$ for the $i^{th}$ color of sub-pixel included in the $t^{th}$ pixel.

In some embodiments, the sum of the luminance loss values for the $i^{th}$ sub-pixels included in the N pixels NPIX is $$\Delta L_i = \frac{x}{a} L_{ti},$$

wherein $L_{ti}$ is the theoretical white balanced luminance value for the $i^{th}$ sub-pixel included in the $t^{th}$ pixel, $$\frac{x}{a}$$

is the invalid display pixel occupancy for the $i^{th}$ sub-pixel included in the $t^{th}$ pixel, a is the area of the theoretical display region for the $i^{th}$ sub-pixel included in the $t^{th}$ pixel, and x is the area of the invalid display pixel region for the $i^{th}$ sub-pixel included in the $t^{th}$ pixel.

The luminance controlling values for the other colors of sub-pixels except for the $i^{th}$ color of sub-pixel included in each pixel are set to:

$$\Delta L_{js} = \frac{\frac{x}{a} L_{ti}}{\sum_{j=1}^{N} L_{ji}} L_{js},$$

wherein $$\sum_{j=1}^{N} L_{ji}$$

indicates for the sum of the theoretical white balanced luminance values for the $i^{th}$ color of sub-pixels included in the N pixels, $L_{ji}$ indicates for the theoretical white balanced luminance value for the $i^{th}$ color of sub-pixel included in a $j^{th}$ pixel of the N pixels, $L_{js}$ indicates for the theoretical white balanced luminance value for a $s^{th}$ color of sub-pixel included in the $j^{th}$ pixel, and $\Delta L_{js}$ indicates for a luminance controlling parameter for a $s^{th}$ color of sub-pixel included in the $j^{th}$ pixel, wherein j is an index number of the pixel which is greater than or equal to 1 and less than or equal to N, and s is an index number of other colors of sub-pixels except for the $i^{th}$ color of sub-pixel included in each pixel which is an integer greater than 0 and not equal to i.

Figure 5:
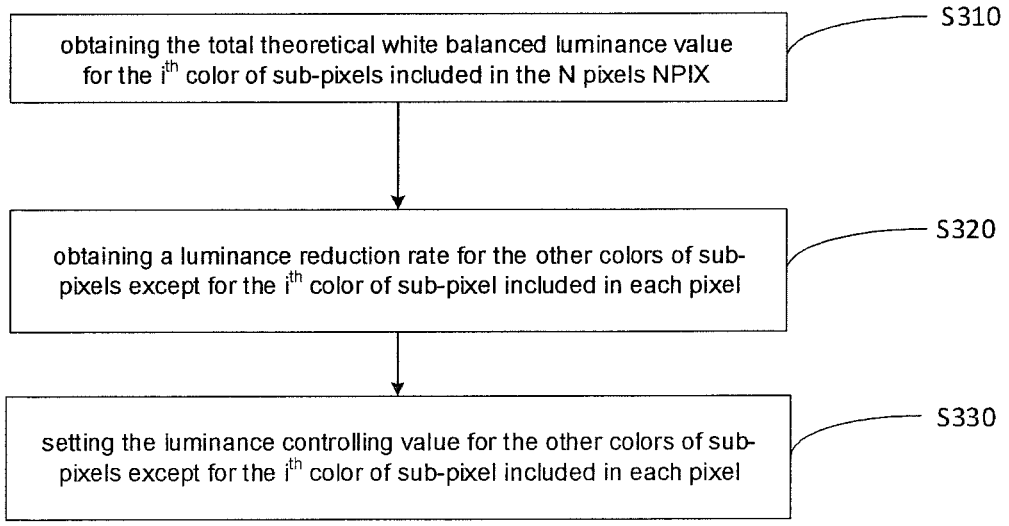
FIG. 5 shows a flowchart of setting luminance controlling values of other colors of sub-pixels except for the $i^{th}$ color of sub-pixel included in each pixel according to an embodiment of the present disclosure.

In some embodiments, as shown in FIG. 5, the step of setting a luminance controlling value for other colors of sub-pixels except for a $i^{th}$ color of sub-pixel included in each of the N pixels, according to the theoretical white balanced luminance value for each color of sub-pixel included in each pixel and a sum of the luminance loss values for the $i^{th}$ color of sub-pixels included in the N pixels NPIX may include the following steps.

In step S310, the sum of the theoretical white balanced luminance values for the $i^{th}$ color of sub-pixels included in the N pixels NPIX is obtained according to the theoretical white balanced luminance values for the $i^{th}$ color of sub-pixels included in each of the N pixels NPIX.

In step S320, a luminance reduction rate $\eta_{js}$ for the other colors of sub-pixels except for the $i^{th}$ color of sub-pixel included in each pixel is obtained according to the sum of the theoretical white balanced luminance values and the sum of the luminance loss values for the $i^{th}$ color of sub-pixels included in the N pixels. For example, the luminance reduction rate for the other colors of sub-pixels except for the $i^{th}$ color of sub-pixel included in each pixel is $$\eta_{js} = \frac{\frac{x}{a} L_{ti}}{\sum_{j=1}^{N} L_{ji}},$$

wherein j is the index number of the pixel which is greater than or equal to 1 and less than or equal to N, and s is an index number of other colors of sub-pixels except for the $i^{th}$ color of sub-pixel included in each pixel which is an integer greater than 0 and not equal to i.

In step S330, the luminance controlling value for the other colors of sub-pixels except for the $i^{th}$ color of sub-pixel included in each pixel is set according to the luminance reduction rate $\eta_{js}$ and the theoretical whites balanced luminance value for the other colors of sub-pixels except for the $i^{th}$ color of sub-pixel included in each pixel.

Figure 6:
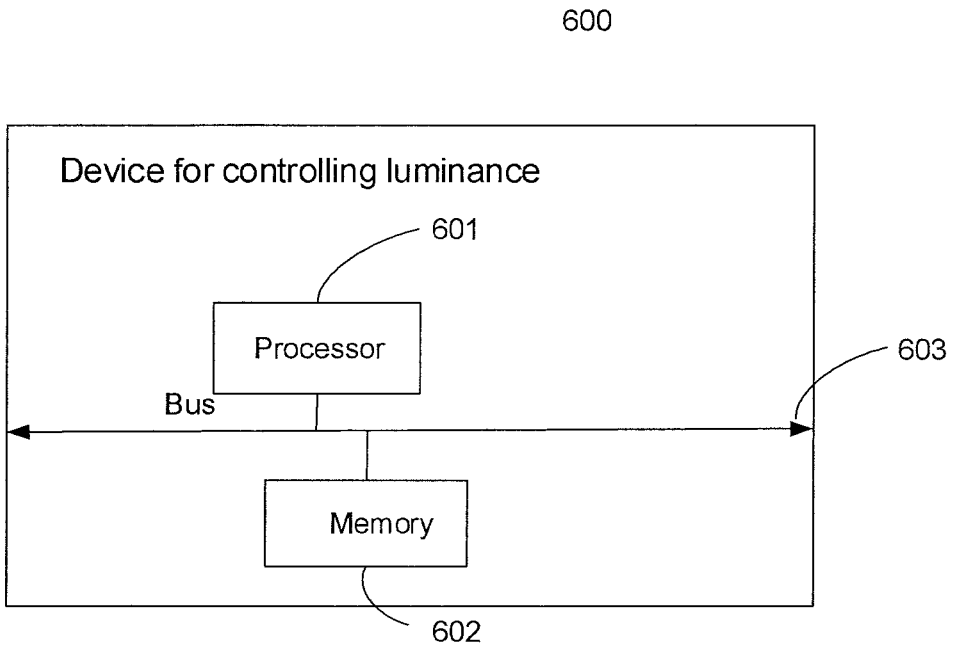
FIG. 6 shows a block diagram illustrating another example of the structure of the device for controlling luminance according to an embodiment of the present disclosure.

As shown in FIG. 6, an embodiment of the present disclosure also provides an exemplary luminance controlling terminal 600. The luminance controlling terminal 600 can include a processor 601 and a memory 602. The processor 601 and the memory 602 can communicate with each another via a bus 603. The memory 601 is configured to store a plurality of instructions so as to implement the method for controlling luminance described above.

The processor 601 according to the embodiment of the present disclosure may be one processor or a collective name for multiple processing elements. For example, the processor 601 may be a central processing unit (CPU), or may be an application specific integrated circuit (ASIC), or one or more integrated circuit configured to implement the embodiments of the present disclosure, such as one or more digital signal processors (DSPs), or one or more Field Programmable Gate Arrays (FPGAs).

The memory 602 may be one storage device or a collective name for multiple storage elements, and is used to store executable program code or the like. The memory 602 may include random access memory (RAM), or non-volatile memory such as a magnetic disk memory, a flash memory, or the like.

The bus 603 may be an Industry Standard Architecture (ISA) bus, a Peripheral Component Interconnection (PCI) bus, or an Extended Industry Standard Architecture (EISA) bus. The bus 603 can be divided into an address bus, a data bus, a control bus, and the like. For ease of representation, only one bold line is shown in FIG. 6, but it does not mean that there is only one bus or only one type of bus.

The various embodiments in the specification are described in a progressive manner. The same or similar parts between the various embodiments may be referred to each other. Each embodiment focuses on the differences from the other embodiments. In particular, for the device embodiment, since it is basically similar to the method embodiment, the description is relatively simple, and the relevant parts can be referred to the description of the method embodiment.

Those skilled in the art can understand that all or part of the processes for implementing the above embodiment method can be achieved by instructing related hardware via a computer program. The computer program can be stored in a computer readable storage medium. and configured to implement a flow of the method embodiments as described above when being executed. The computer readable storage medium may be a magnetic disk, an optical disk, a read-only memory (ROM), or a random access memory (RAM).

An embodiment of the present disclosure also provides a display device including the luminance controlling device discussed above.

The display device according to the above embodiments may be any product or component having a display function, such as a mobile phone, a tablet computer, a television, a display, a notebook computer, a digital photo bezel, or a navigator.

If the edge pixel EPIX0 is blocked, as shown in FIG. 1, the N pixels NPIX are arranged along an extending direction of the bezel of the display device, and the $t^{th}$ pixel in the N pixels NPIX is closest to the bezel.

In the description of the above embodiments, specific features, structures, materials or characteristics may be combined in any suitable manner in any one or more embodiments or examples.

The above description is only a specific implementation of the present disclosure, but the scope of the present disclosure is not limited thereto. Those skilled in the art can make various changes or substitutions without departing from the scope of the disclosure. Such changes or substitutions should be also covered within the scope of the present disclosure. Therefore, the scope of the present disclosure should be defined by the claims.

We claim:

1. A device for controlling luminance, comprising:

a memory configured to store instructions; and at least one processor configured to execute the instructions stored in the memory to:

obtain a theoretical white balanced luminance value for each color of sub-pixel included in N pixels, wherein the N pixels are adjacent, and N is an integer greater than or equal to 1;

set a luminance controlling value for other colors of sub-pixels except for an $i^{th}$ color of sub-pixel included in each of the N pixels, according to the theoretical white balanced luminance value for each color of sub-pixel and a sum of the luminance loss values for the $i^{th}$ color of sub-pixels included in the N pixels, in response to the $i^{th}$ color of sub-pixel included in a $t^{th}$ pixel of the N pixels having a luminance loss, wherein t is an integer greater than or equal to 1 and less than or equal to N, and i is an integer greater than or equal to 1; and adjust luminance of the other colors of sub-pixels except for the $i^{th}$ color of sub-pixels included in the N pixels according to the luminance controlling value, so that a ratio among a sum of the luminance values of the $i^{th}$ color of sub-pixels included in the N pixels and a sum of the adjusted luminance values of the other colors of sub-pixels except for the $i^{th}$ color of sub-pixels included in the N pixels is coincident with a white balanced luminance value ratio.

2. The device of claim 1, wherein the processor is further configured to set the luminance controlling value for the other colors of sub-pixels, so as to satisfy at least one of:

a ratio between the luminance controlling value and the theoretical white balanced luminance value for each of the other colors of sub-pixels except for the $i^{th}$ color of sub-pixel included in each pixel being equal to a ratio between the sum of the luminance loss values and a sum of the theoretical white balanced luminance values for the $i^{th}$ color of sub-pixels included in the N pixels, and a ratio between a sum of the luminance controlling values and the sum of theoretical white balanced luminance value for each of the other colors of sub-pixels except for the $i^{th}$ color of sub-pixel included in the N adjacent pixel being equal to a ratio between the sum of the luminance loss values and the sum of the theoretical white balanced luminance values for the $i^{th}$ color of sub-pixels included in the N pixels.

3. The device of claim 1, wherein the processor is further configured to adjust the luminance of the other colors of sub-pixels, so as to satisfy at least one of:

a ratio among the adjusted luminance values of the other colors of sub-pixels except for the $i^{th}$ color of sub-pixel included in each pixel being equal to the theoretical white balanced luminance value ratio of the other colors of sub-pixels; or a ratio among the adjusted luminance values of the same color of sub-pixels except for the $i^{th}$ color of sub-pixels included in the N pixels being equal to the theoretical white balanced luminance value ratio of the same color of sub-pixels.

4. The device of claim 3, wherein the processor is further configured to obtain the sum of the theoretical white balanced luminance values for the $i^{th}$ color of sub-pixels included in the N pixels, according to the theoretical white balanced luminance values for the $i^{th}$ color of sub-pixel included in each of the N pixels; obtain a luminance reduction rate $\eta_{js}$ for the other colors of sub-pixels except for the $i^{th}$ color of sub-pixel included in each pixel, according to the sum of the theoretical white balanced luminance values and the sum of the luminance loss values for the $i^{th}$ color of sub-pixels included in the N pixels; and obtain the luminance controlling value for the other colors of sub-pixels except for the $i^{th}$ color of sub-pixel included in each pixel, according to the luminance reduction rate $\eta_{js}$ and the theoretical whites balanced luminance value for the other colors of sub-pixels except for the $i^{th}$ color of sub-pixel included in each pixel.

5. The device of claim 4, wherein the luminance reduction rate for the other colors of sub-pixels except for the $i^{th}$ color of sub-pixel included in each pixel is as follows:

$$\eta_{js} = \frac{\frac{x}{a} L_{ti}}{\sum_{j=1}^{N} L_{ji}},$$

wherein j is the index number of the pixel which is greater than or equal to 1 and less than or equal to N, and s is an index number of other colors of sub-pixels except for the $i^{th}$ color of sub-pixel included in each pixel, and is an integer greater than 0 and not equal to i.

6. The device of claim 1, wherein the $i^{th}$ color of sub-pixel has an invalid display region; and the processor is further configured to:

obtain an invalid display pixel occupancy $$\frac{x}{a}$$

for the $i^{th}$ color of sub-pixel included in the $t^{th}$ pixel, according to an area of the invalid display region x and the area of a theoretical display region a for the $i^{th}$ color of sub-pixel included in the $t^{th}$ pixel; obtain the luminance loss value $\Delta L_{ti}$ for the $i^{th}$ color of sub-pixel included in the $t^{th}$ pixel, according to the invalid display pixel occupancy $$\frac{x}{a}$$

and the theoretical white balanced luminance value $L_{ti}$ for the $i^{th}$ color of sub-pixel, wherein $$\Delta L_{ti} = \frac{x}{a} L_{ti};$$

and obtain the sum of the luminance loss values $\Delta L_i$ for the $i^{th}$ color of sub-pixels included in the N pixels, according to the luminance loss value $\Delta L_{ti}$ for the $i^{th}$ color of sub-pixel included in the $t^{th}$ pixel.

7. The device of claim 6, wherein the luminance controlling value for other colors of sub-pixels except for the $i^{th}$ color of sub-pixel included in each pixel are set to $$\Delta L_{js} = \frac{\frac{x}{a} L_{ti}}{\sum_{j=1}^{N} L_{ji}} L_{js},$$

wherein $$\sum_{j=1}^{N} L_{ji}$$

indicates for the sum of the theoretical white balanced luminance values for the $i^{th}$ color of sub-pixels included in the N pixels, $L_{ji}$ indicates for the theoretical white balanced luminance value for the $i^{th}$ color of sub-pixel included in a $j^{th}$ pixel of the N pixels, $L_{js}$ indicates for the theoretical white balanced luminance value for a $s^{th}$ color of sub-pixel included in the $j^{th}$ pixel, and $\Delta L_{js}$ indicates for a luminance controlling parameter for a $s^{th}$ color of sub-pixel included in the $j^{th}$ pixel, wherein j is an index number of the pixel which is greater than or equal to 1 and less than or equal to N, and s is an index number of other colors of sub-pixels except for the $i^{th}$ color of sub-pixel included in each pixel, and is an integer greater than 0 and not equal to i.

8. A display device comprising the device of claim 1.

9. The display device of claim 8, further comprising a bezel;

wherein the N pixels are arranged along an extending direction of the bezel, and the $t^{th}$ pixel of the N pixels is closest to the bezel.

10. A method of controlling a luminance, comprising:

obtaining a theoretical white balanced luminance value for each color of sub-pixel included in N pixels, wherein N is an integer greater than or equal to 1;

setting a luminance controlling value for other colors of sub-pixels except for an $i^{th}$ color of sub-pixel included in each of the N pixels, according to the theoretical white balanced luminance value for each color of sub-pixel and a sum of the luminance loss values for the $i^{th}$ color of sub-pixels included in the N pixels, in response to the $i^{th}$ color of sub-pixel included in a $t^{th}$ pixel of the N pixels having a luminance loss, wherein t is an integer greater than or equal to 1 and less than or equal to N, and i is an integer greater than or equal to 1; and adjusting luminance of the other colors of sub-pixels according to the luminance controlling value, so that a ratio among a sum of the luminance values of the $i^{th}$ color of sub-pixels included in the N pixels and a sum of the adjusted luminance values of the other colors of sub-pixels except for the $i^{th}$ color of sub-pixels included in the N pixels is coincident with a white balanced luminance value ratio.

11. The method of claim 10, wherein setting luminance controlling value for the other colors of sub-pixels so as to satisfy at least one of:

a ratio between the luminance controlling value and the theoretical white balanced luminance value for each of the other colors of sub-pixels except for the $i^{th}$ color of sub-pixel included in each pixel being equal to a ratio between the sum of the luminance loss values and a sum of the theoretical white balanced luminance values for the $i^{th}$ color of sub-pixels included in the N pixels, and a ratio between a sum of the luminance controlling values and the sum of the theoretical white balanced luminance values for each of the other colors of sub-pixels except for the $i^{th}$ color of sub-pixel included in the N adjacent pixel being equal to a ratio between the sum of the luminance loss values and the sum of the theoretical white balanced luminance values for the $i^{th}$ color of sub-pixels included in the N pixels.

12. The method of claim 10, wherein the $i^{th}$ color of sub-pixel included in the $t^{th}$ pixel has an invalid display region; and the method further comprising:

obtaining an invalid display pixel occupancy $$\frac{x}{a}$$

for the color of sub-pixel included in the $t^{th}$ pixel, according to an area of the invalid display region x and the area of a theoretical display region a for the $i^{th}$ color of sub-pixel included in the $t^{th}$ pixel;

obtaining the luminance loss value $\Delta L_{ti}$ for the $i^{th}$ color of sub-pixel included in the $t^{th}$ pixel, according to the invalid display pixel occupancy $$\frac{x}{a}$$

and the theoretical white balanced luminance value $L_{ti}$ for the $i^{th}$ color of sub-pixel, wherein $$\Delta L_{ti} = \frac{x}{a} L_{ti};$$

and obtaining the sum of the luminance loss values $\Delta L_i$ for the $i^{th}$ color of sub-pixels included in the N pixels, according to the luminance loss value $\Delta L_{ti}$ for the $i^{th}$ color of sub-pixel included in the $t^{th}$ pixel.

13. The method of claim 12, wherein the luminance controlling value for other colors of sub-pixels except for the $i^{th}$ color of sub-pixel included in each pixel are set to $$\Delta L_{js} = \frac{\frac{x}{a} L_{ti}}{\sum_{j=1}^{N} L_{ji}} L_{js},$$

wherein $$\sum_{j=1}^{N} L_{ji}$$

indicates for the sum of the theoretical white balanced luminance values for the $i^{th}$ color of sub-pixels included in the N pixels, $L_{ji}$ indicates for the theoretical white balanced luminance value for the $i^{th}$ color of sub-pixel included in a $j^{th}$ pixel of the N pixels, $L_{js}$ indicates for the theoretical white balanced luminance value for a $s^{th}$ color of sub-pixel included in the $j^{th}$ pixel, and $\Delta L_{js}$ indicates for a luminance controlling parameter for a $s^{th}$ color of sub-pixel included in the $j^{th}$ pixel, wherein j is an index number of the pixel which is greater than or equal to 1 and less than or equal to N, and s is an index number of other colors of sub-pixels except for the $i^{th}$ color of sub-pixel included in each pixel, and is an integer greater than 0 and not equal to i.

14. The method of claim 10, wherein the luminance controlling value for the other colors of sub-pixels except for the $i^{th}$ color of sub-pixel included in each of the N pixels is set according to the theoretical white balanced luminance value for each color of sub-pixel and a sum of the luminance loss values for the $i^{th}$ color of sub-pixels included in the N pixels by:

obtaining the sum of the theoretical white balanced luminance values for the $i^{th}$ color of sub-pixels included in the N pixels, according to the theoretical white balanced luminance values for the $i^{th}$ color of sub-pixel included in each of the N pixels;

obtaining a luminance reduction rate $\eta_{js}$ for the other colors of sub-pixels except for the $i^{th}$ color of sub-pixel included in each pixel, according to the sum of the theoretical white balanced luminance values and the sum of the luminance loss values for the $i^{th}$ color of sub-pixels included in the N pixels; and obtaining the luminance controlling value for the other colors of sub-pixels except for the $i^{th}$ color of sub-pixel included in each pixel, according to the luminance reduction rate $\eta_{js}$ and the theoretical whites balanced luminance value for the other colors of sub-pixels except for the $i^{th}$ color of sub-pixel included in each pixel.

15. The method of claim 14, wherein the luminance reduction rate for the other colors of sub-pixels except for the $i^{th}$ color of sub-pixel included in each pixel is as follows:

$$\eta_{js} = \frac{\frac{x}{a} L_{ti}}{\sum_{j=1}^{N} L_{ji}},$$

wherein j is the index number of the pixel which is greater than or equal to 1 and less than or equal to N, and s is an index number of other colors of sub-pixels except for the $i^{th}$ color of sub-pixel included in each pixel, and is an integer greater than 0 and not equal to i.

16. The method of claim 10, wherein the luminance of the other colors of sub-pixels is adjusted so as to satisfy at least one of:

a ratio among the adjusted luminance values of the other colors of sub-pixels except for the $i^{th}$ color of sub-pixel included in each pixel being equal to the theoretical white balanced luminance value ratio of the other colors of sub-pixels; or a ratio among the adjusted luminance values of the same color of sub-pixels except for the $i^{th}$ color of sub-pixels included in the N pixels being equal to the theoretical white balanced luminance value ratio of the same color of sub-pixels.

* * * * *